US007891752B2

(12) United States Patent
Liu et al.

(10) Patent No.: US 7,891,752 B2
(45) Date of Patent: Feb. 22, 2011

(54) INKJET APPARATUS AND CALIBRATION METHODS THEREOF

(75) Inventors: Tsu-Min Liu, Hsinchu County (TW); Jeng-Han Lee, Taipei County (TW); Chieh-Yi Huang, Hsinchu County (TW); Chia-Ming Chang, Taipei County (TW); Chao-Kai Cheng, Miaoli County (TW); Yuh-Zheng Lee, Hsinchu (TW)

(73) Assignee: Industrial Technology Research Institute, Hsinchu (TW)

( * ) Notice: Subject to any disclaimer, the term of this patent is extended or adjusted under 35 U.S.C. 154(b) by 381 days.

(21) Appl. No.: 12/056,234

(22) Filed: Mar. 26, 2008

(65) Prior Publication Data

US 2009/0073205 A1 Mar. 19, 2009

(30) Foreign Application Priority Data

Sep. 17, 2007 (CN) ..... 2007 1 0153582

(51) Int. Cl.
*B41J 29/393* (2006.01)

(52) U.S. Cl. ..... 347/14; 347/19

(58) Field of Classification Search ..... 347/94, 347/15, 17, 19, 57, 5, 9–12, 14, 68–71, 78, 347/81

See application file for complete search history.

(56) References Cited

U.S. PATENT DOCUMENTS

| | | | | |
|---|---|---|---|---|
| 5,037,217 | A | 8/1991 | Suzuki et al. | |
| 6,286,922 | B1 | 9/2001 | Kondou | |
| 7,175,248 | B2 * | 2/2007 | Wade | 347/19 |
| 2003/0132981 | A1 * | 7/2003 | Arakawa et al. | 347/19 |

FOREIGN PATENT DOCUMENTS

| | | | |
|---|---|---|---|
| CN | 2797037 | Y | 7/2006 |
| JP | 2006088605 | A | 4/2006 |
| JP | 2006137124 | A | 6/2006 |

* cited by examiner

*Primary Examiner*—Thinh H Nguyen

(57) ABSTRACT

An Inkjet apparatus is provided. An Inkjet apparatus includes a piezoelectric inkjet print head, a plurality of driving unit, a detection unit and a control unit. The piezoelectric inkjet print head comprises a plurality of nozzles, wherein each the nozzle outputs an ink drop according to a driving voltage. The driving unit generates the driving voltage according to a control signal. The detection unit detects a state of the ink drop corresponding to the nozzle to generate a detection signal. The control unit generates the control signal to control the driving voltage according to the detection signal.

20 Claims, 8 Drawing Sheets

200

INKJET APPARATUS AND CALIBRATION METHODS THEREOF

BACKGROUND OF THE INVENTION

1. Field of the Invention

The invention relates to an inkjet apparatus, and more particularly to a calibration method for an inkjet apparatus.

2. Description of the Related Art

FIG. 1 shows a diagram of a conventional piezoelectric inkjet print head 10. In FIG. 1, the piezoelectric inkjet print head 10 comprises a plurality of nozzles, such as 256 nozzles. An equivalent circuit of each nozzle is shown as a capacitor $C_L$, i.e. a capacitor $C_{L1}$ represents a $1^{st}$ nozzle and a capacitor $C_{L256}$ represents a $256^{th}$ nozzle. Typically, each nozzle of the piezoelectric inkjet print head is driven by the same driving signal. However, each nozzle has different impedance due to the fluctuations of piezoelectricity thin film processing and different aging of nozzles. Thus, if each nozzle of the inkjet print head is driven by the same driving signal, a portion of the nozzles are unable to drop ink such that efficiency of the inkjet print head 10 is gradually decreased. Additionally, when the same driving signal is used to drive each nozzle, some nozzles will drop defect ink, such as different drop volume or flying speed. With abnormal nozzles sacrificed due to the defect ink, the utility rate of the nozzles is decreased, along with printing speed and printing quality.

U.S. Pat. No. 5,037,217 discloses a printer system for controlling a piezoelectric inkjet print head, wherein the system detects a thickness of a recording medium and ambient temperature to determine a dynamic voltage and a static voltage, respectively. Hence, the piezoelectric inkjet print head operates between the dynamic and static voltages when a print process is performed. Moreover, U.S. Pat. No. 6,286,922 discloses a control system for controlling a driving pulse of a piezoelectric element in an inkjet print head. For the driving pulse, a rising slope and a falling slope of a voltage waveform of the driving pulse are determined by a control signal and a pulse generator. Hence, the control system measures a maximum voltage value of the driving pulse and adjusts the control signal, such that the maximum voltage value of the driving pulse will reach a predetermined voltage value.

BRIEF SUMMARY OF THE INVENTION

Inkjet apparatus and calibration methods thereof are provided. An exemplary embodiment of such an inkjet apparatus comprises a piezoelectric inkjet print head, a plurality of driving unit, a detection unit and a control unit. The piezoelectric inkjet print head comprises a plurality of nozzles, wherein each the nozzle outputs an ink drop according to a driving voltage. The driving unit generates the driving voltage according to a control signal. The detection unit detects a state of the ink drop corresponding to the nozzle to generate a detection signal. The control unit generates the control signal to control the driving voltage according to the detection signal.

Furthermore, an exemplary embodiment of a calibration method for an inkjet apparatus having a piezoelectric inkjet print head with a plurality of nozzles comprises: performing an initial setting for setting a reference voltage; performing a self-tuning process for measuring a driving voltage of the nozzle, and adjusting a voltage level of the driving voltage according to the reference voltage and a control signal, wherein the driving voltage corresponds to the control signal; performing a user-tuning process for detecting an output ink drop of the nozzle, and adjusting the control signal corresponding to the nozzle to control the voltage level or a duty cycle of the driving voltage according to a status of the output ink; and storing a parameter corresponding to the control signal to a memory.

A detailed description is given in the following embodiments with reference to the accompanying drawings.

BRIEF DESCRIPTION OF DRAWINGS

The invention can be more fully understood by reading the subsequent detailed description and examples with references made to the accompanying drawings, wherein.

DETAILED DESCRIPTION OF THE INVENTION

The following description is of the best-contemplated mode of carrying out the invention. This description is made for the purpose of illustrating the general principles of the invention and should not be taken in a limiting sense. The scope of the invention is best determined by reference to the appended claims.

Figure 1:
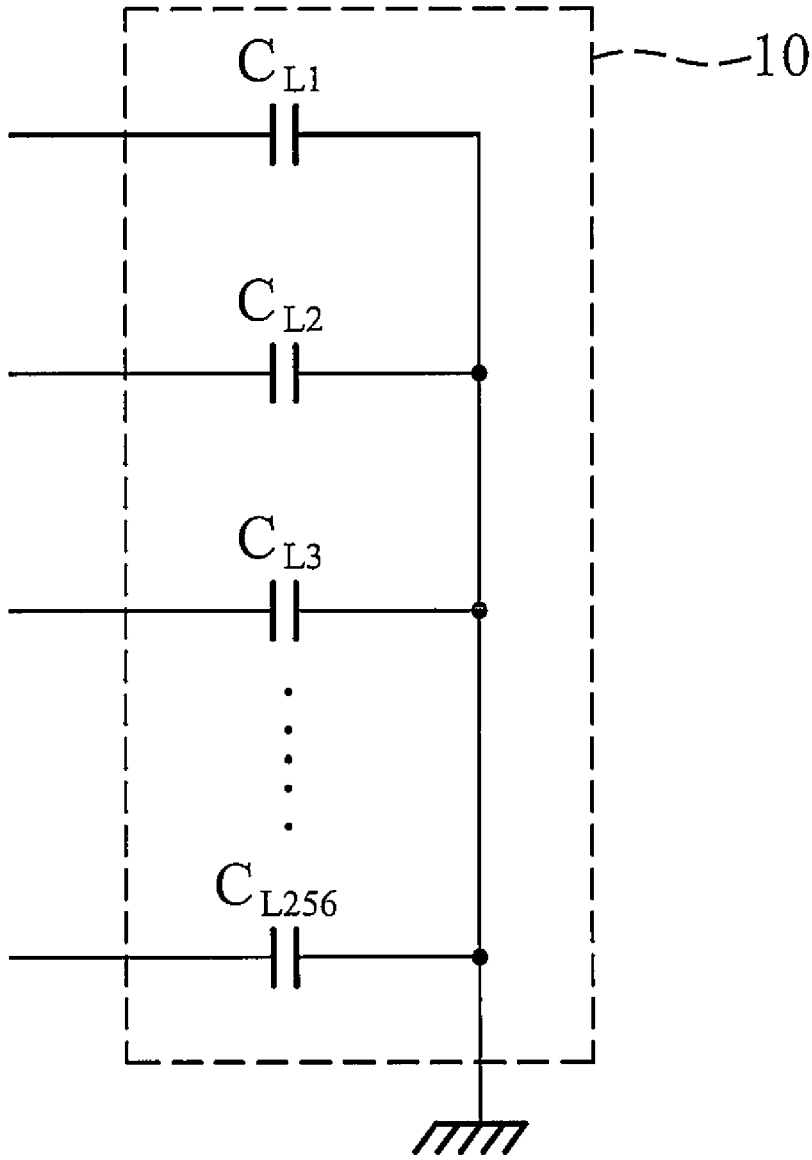
FIG. 1 ( PRIOR ART )
FIG. 1 shows a diagram of a conventional piezoelectric inkjet print head.
Figure 2:
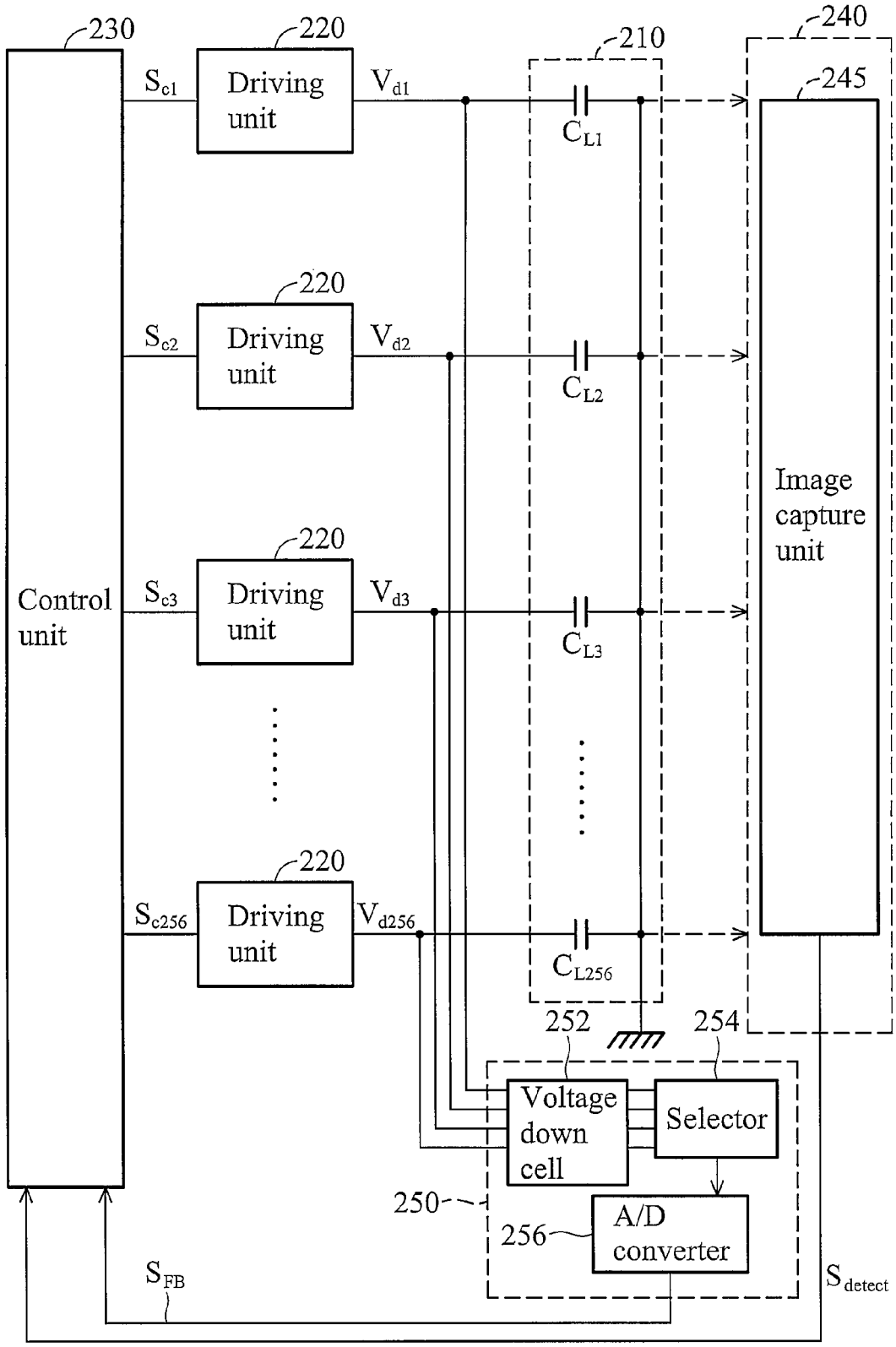
FIG. 2 shows an inkjet apparatus according to an embodiment of the invention.

FIG. 2 shows an inkjet apparatus 200 according to an embodiment of the invention. The inkjet apparatus 200 comprises a piezoelectric inkjet print head 210, a plurality of driving unit 220, a control unit 230, a detection unit 240 and a feedback unit 250. The piezoelectric inkjet print head 210 comprises a plurality of nozzles, wherein an equivalent circuit of each nozzle is shown as a capacitor $C_L$. Each nozzle has a corresponding driving unit 220 for providing a driving voltage $V_d$ to obtain identical ink drop status from each nozzle due different impedances for each nozzle. Each driving unit 220 has a corresponding control signal $S_c$. For example, the driving unit 220 generates a driving voltage $V_{d1}$ to drive a nozzle $C_{L1}$ according to a control signal $S_{c1}$. The feedback unit 250 comprises a voltage down cell 252, a selector 254 and an analog to digital (A/D) converter 256. The voltage down cell 252 receives the driving voltage $V_d$ of each nozzle and reduces voltage until it reaches a voltage range which is accepted by the A/D converter 256. For example, the selector 254 selects a reduced driving voltage corresponding to the driving voltage $V_{d1}$ according to the control unit 230, and the reduced driving voltage is sent to the A/D converter 256 to generate a feedback signal $S_{FB}$. The control unit 230 receives the feedback signal $S_{FB}$ to obtain an actual voltage value of the driving voltage $V_{d1}$, and adjusts the control signal $S_{c1}$ to re-drive the nozzle $C_{L1}$ according to the feedback signal $S_{FB}$ until the actual voltage value of the driving voltage $V_{d1}$ is substantially equal to a target value. After calibration of the nozzle $C_{L1}$ is completed, a parameter corresponding to the control signal $S_{c1}$ is stored in a memory (not shown), wherein the parameter is used for performing a print process of the piezoelectric inkjet print head 210. In one embodiment, the selector 254 is an analog switch. In one embodiment, except for the driving voltage $V_d$, the feedback unit 250 also generates the feedback signal $S_{FB}$ according to environment parameters, such as temperature, humidity or atmospheric pressure etc.

Furthermore, the detection unit 240 comprises an image capture unit 245. The image capture unit 245 captures an ink drop image and detects flying speed, drop volume, length of drop tails, flying direction or satellite drop of the ink drop to generate a detection signal $S_{detect}$. Then, the control unit 230 adjusts the control signal $S_c$ according to the detection signal $S_{detect}$, and drives the nozzle to detect the ink drop again. The control unit 230 may maintain a minimum difference between different inks from each nozzle through the detection unit 240. In one embodiment, the control unit 230 comprises a memory unit for storing parameters corresponding to the control signal $S_c$. In one embodiment, the control unit 230 comprises a proportional integral differential (PID) controller, a Fuzzy controller or a back propagation controller.

Figure 3:
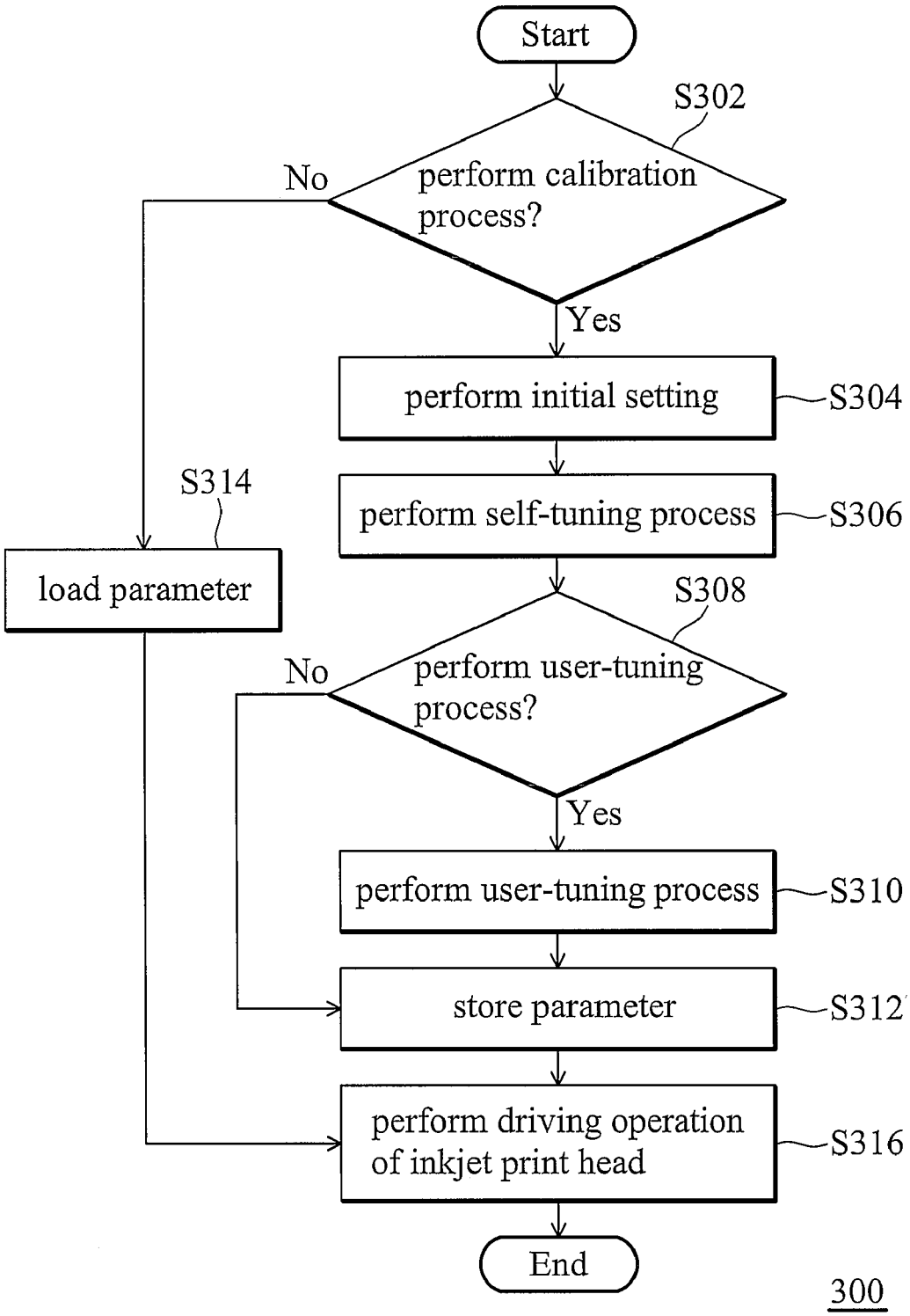
FIG. 3 shows a calibration method for an inkjet apparatus according to an embodiment of the invention.

FIG. 3 shows a calibration method 300 of an inkjet apparatus according to an embodiment of the invention. The calibration method 300 is applied during the following statuses: 1) an inkjet print head is installed in a printer system; 2) the printer system is powered on; or 3) the inkjet print head is operated for a long period of time. First, in step S302, it is determined whether a calibration process is needed to be performed. If so, the calibration process is performed. Next, in step S304, an initial setting is performed to set a voltage level and a waveform of a reference voltage $V_t$. Then, a self-tuning process is performed in step S306, wherein the self-tuning process will be described below. Next, in step S308, it is determined whether a user-tuning process is needed to be performed. If so, the user-tuning process is performed in step S310, wherein the user-tuning process will also be described below. In step S312, parameters of the driving voltage $V_d$ corresponding to each nozzle are stored in a memory so as to perform a print process (step S316) when the user-tuning process is completed, or the self-tuning process is completed and the user-tuning process is not needed to be performed. Furthermore, if the calibration process is not needed to be performed (step S302), the parameters of the driving voltage $V_d$ corresponding to each nozzle are loaded from the memory in step S314 before a driving operation of the inkjet print head is performed (step S316). The loaded parameters are stored when the last self-tuning process or the last user-tuning process is performed.

Figure 4A:
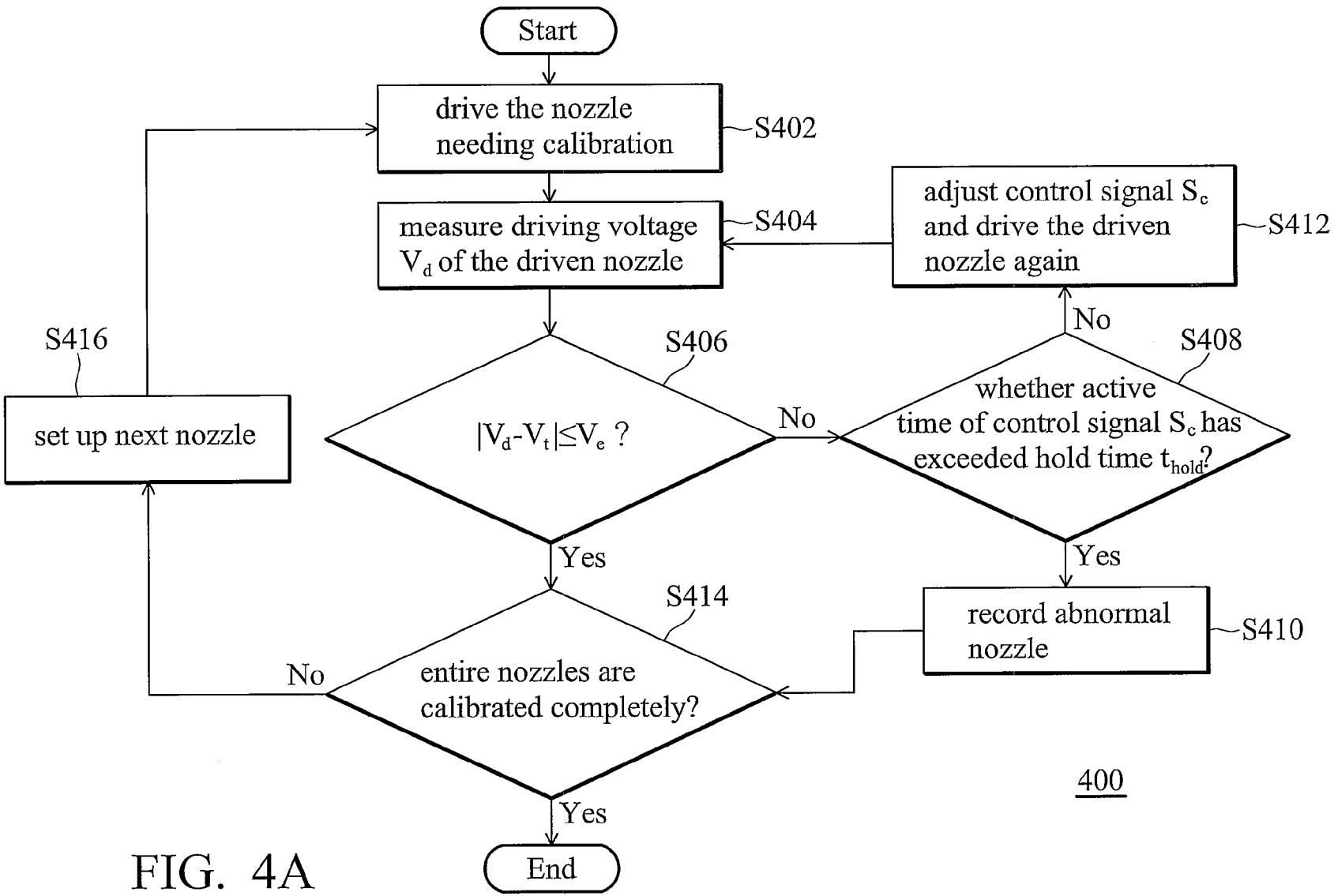
FIG. 4A shows a self-tuning process according to an embodiment of the invention.

FIG. 4A shows a self-tuning process 400 according to an embodiment of the invention. First, in step S402, a nozzle needing calibration is driven. Referring to FIG. 2, in the inkjet apparatus 200, the control unit 230 may generate the corresponding control signal $S_c$ to drive the nozzle needing calibration. Next, in step S404, the driving voltage $V_d$ of the driven nozzle is measured. Next, it is determined whether a voltage difference between the driving voltage $V_d$ and the reference voltage $V_t$ is smaller than or equal to a voltage $V_e$ (step S406), i.e. $|V_d-V_t|\leqq V_e$, wherein the voltage $V_e$ is a tolerable error of the driving voltage $V_d$. Next, it is determined whether an active time of the control signal $S_c$ has exceeded a hold time $t_{hold}$ (step S408) when the voltage difference between the driving voltage $V_d$ and the reference voltage $V_t$ is greater than the voltage $V_e$. If so, the driven nozzle is recorded as an abnormal nozzle (step S410). If not, the control unit 230 will adjust the control signal $S_c$ to drive the driven nozzle again (step S412). After the step S412, measurement and determination of the driving voltage $V_d$ are made again through the steps S404 and S406. Next, it is determined whether entire nozzles of the piezoelectric inkjet print head are calibrated completely (step S414) when the voltage difference between the driving voltage $V_d$ and the reference voltage $V_t$ is smaller than or equal to the voltage $V_e$. If not, a next nozzle needing calibration is set up in step S416. If so, the self-tuning process is completed.

Figure 4B:
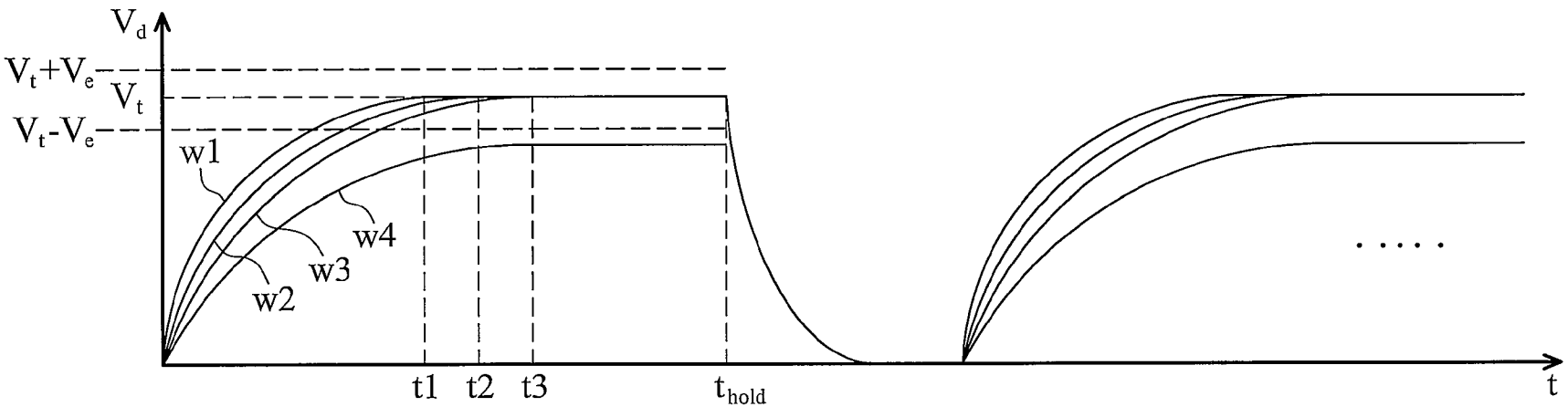
FIG. 4B shows a time chart of the driving voltage measured from the self-tuning process.

FIG. 4B shows a time chart of the driving voltage $V_d$ measured from the self-tuning process. Four waveforms w1, w2, w3 and w4 represent the driving voltage $V_d$ of various nozzles, respectively. As shown in FIG. 4B, the voltages of the waveforms w1, w2 and w3 are adjusted to approximate the reference voltage $V_t$. However, in the hold time $t_{hold}$, a voltage of the waveform w4 is still smaller than the reference voltage $V_t$. Thus, the nozzle corresponding to the waveform w4 is recorded as an abnormal nozzle due to the voltage of the waveform w4 being lower than a voltage ($V_t-V_e$). In one embodiment, the abnormal nozzles will not be used during a print process. In one embodiment, the waveform of the driving voltage $V_d$ may be a ladder wave, a square wave, a triangle wave, a sine wave or combinations thereof.

Figure 5A:
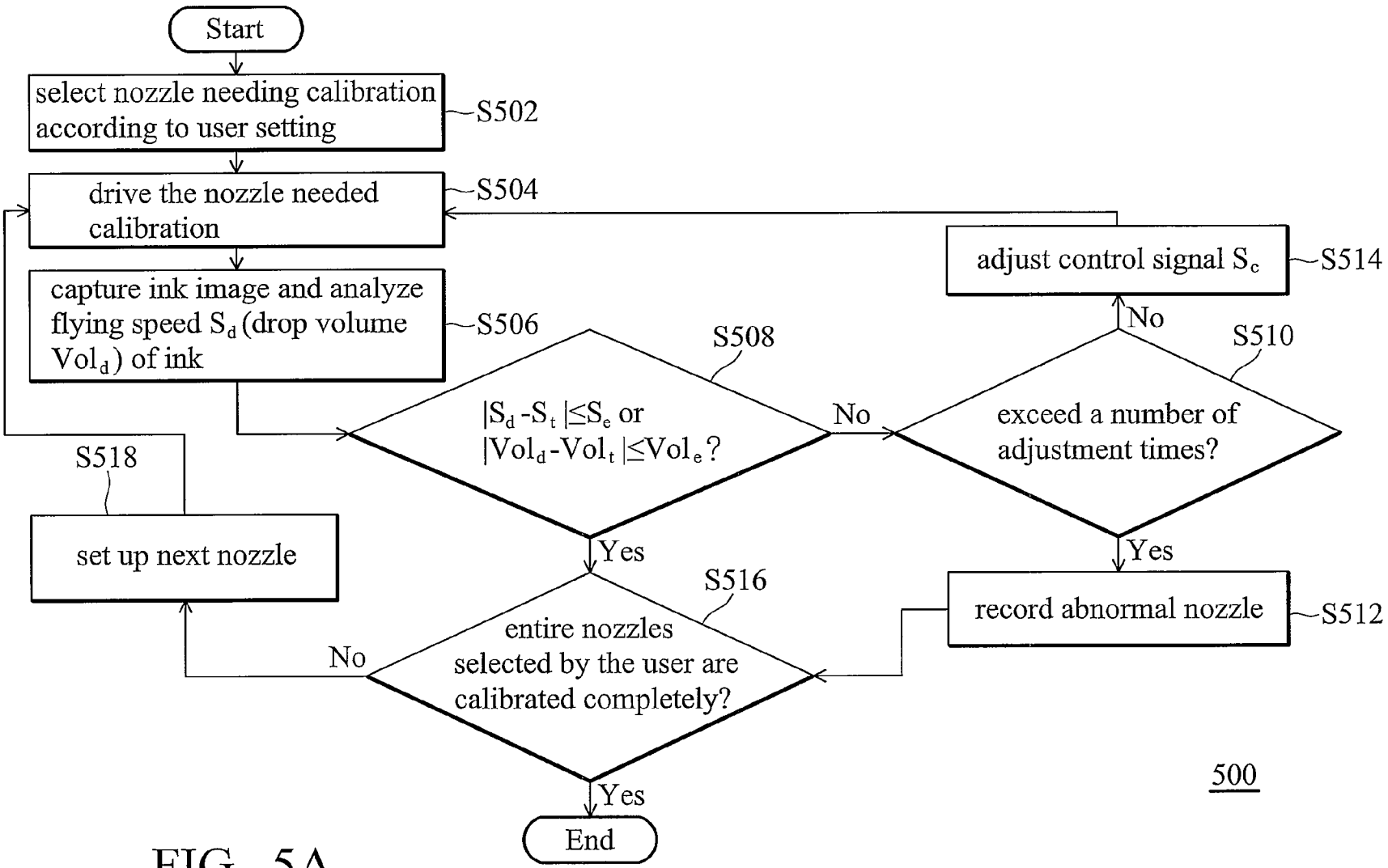
FIG. 5A shows a user-tuning process according to an embodiment of the invention.

FIG. 5A shows a user-tuning process 500 according to an embodiment of the invention. First, a nozzle needing calibration is selected according to a user setting (step S502), and then the nozzle is driven (step S504). A user may set the user setting to calibrate whole nozzles or a portion of nozzles selected from a previous calibration result. Next, in step S506, the detection unit 240 shown in FIG. 2 captures an ink drop image of the driven nozzle and analyzes the ink drop status, such as a flying speed $S_d$ or a drop volume $Vol_d$. Next, in step S508, it is determined whether a speed difference between the flying speed $S_d$ and a target speed $S_t$ is smaller than or equal to a tolerable speed error $S_e$ (i.e. $|S_d-S_t|\leqq S_e$), or a volume difference between the drop volume $Vol_d$ and a target volume $Vol_t$ is smaller than or equal to a tolerable volume error $Vol_e$ (i.e. $|Vol_d-Vol_t|\leqq Vol_e$). If the speed difference is greater than the speed error $S_e$ or the volume difference is greater than the volume error $Vol_e$, it is determined whether a number of adjustment times has been exceeded (step S510). If so, the driven nozzle is recorded as an abnormal nozzle (step S512). If not, the control unit 230 shown in FIG. 2 adjusts the control signal $S_c$ (step S514), and then drives the nozzle again (step S504). After the step S504, measurement and determination of the flying speed $S_d$ or drop volume $Vol_d$ of the ink drop are made again through the steps S506 and S508. Next, it is determined whether entire nozzles selected by the user are calibrated completely (step S516) when the speed difference is smaller than or equal to the speed error $S_e$ or the volume difference is smaller than or equal to the volume error $Vol_e$. If not, a next nozzle needing calibration is set up in step S518. If so, the user-tuning process is completed.

Figure 5B:
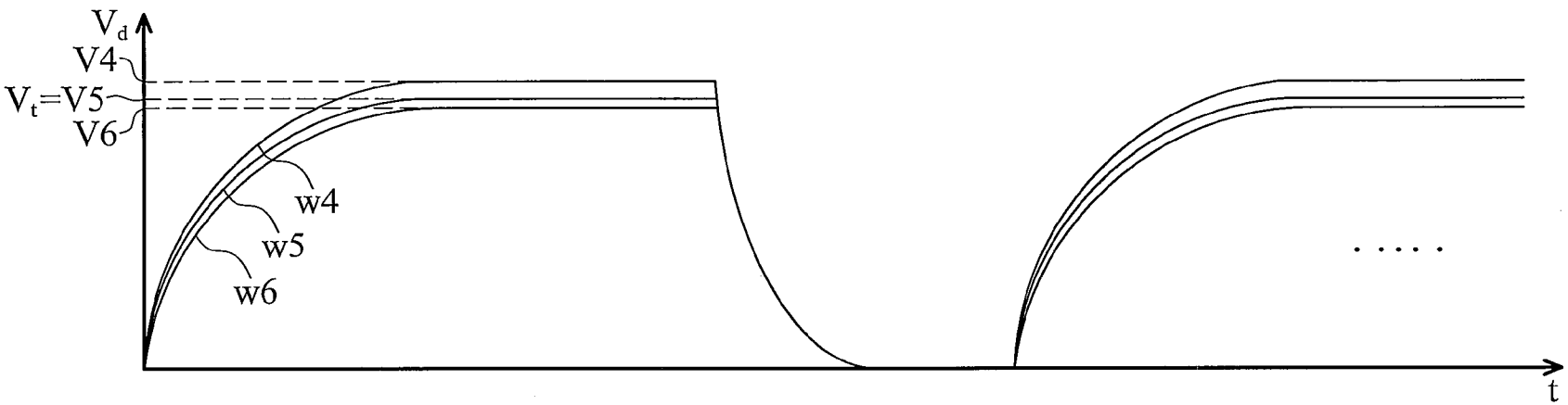
FIGS. 5B and 5C show various time charts of the driving voltage measured from the user-tuning process.
Figure 5C:
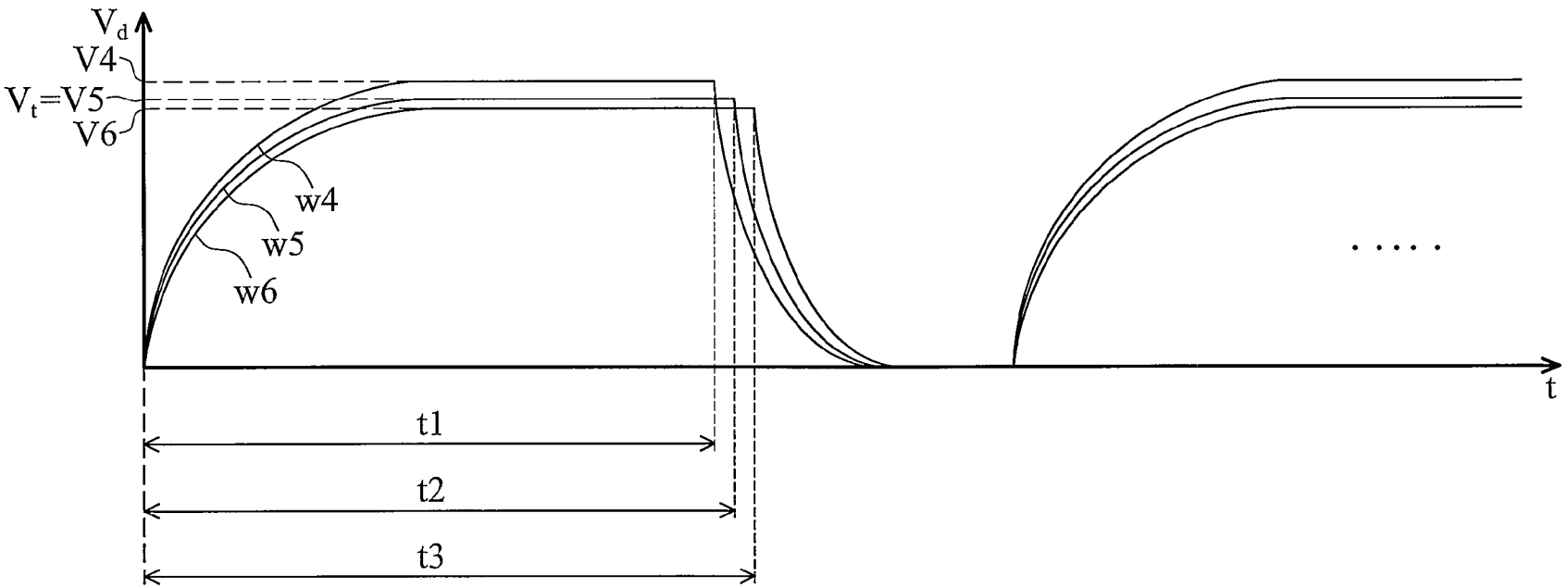

FIGS. 5B and 5C show various time charts of the driving voltage $V_d$ measured from the user-tuning process. In FIG. 5B, the driving voltage $V_d$ of various nozzles have different voltage levels to obtain ink drop uniformity due to differences between ink drop and nozzle characteristics. For example, since each nozzle has different impedance, a nozzle corresponding to a waveform w4 requires a higher driving voltage $V_d$ than a nozzle corresponding to a waveform w6 (i.e. V4>V6). In FIG. 5C, various shoot times of each nozzle (i.e. a duty cycle of the driving voltage $V_d$) are adjusted to reduce drop point difference due to manufacturing position tolerance existing between various nozzles (such as an oblique shoot angle of a nozzle). For example, a duty cycle of a waveform w4 is lesser than a duty cycle of a waveform w6 (i.e. t3>t1). Therefore, a nozzle corresponding to the waveform w4 will complete dropping ink drop earlier than a nozzle corresponding to the waveform w6. Hence, the drop point difference is reduced such that the ink drop of the nozzles corresponding to the waveforms w4 and w6 may arrive at the corresponding destinations simultaneously. Moreover, for the driving voltage $V_d$, the control unit 230 shown in FIG. 2 may generate the control signal $S_c$ to control the voltage level of the driving voltage $V_d$ according to the feedback signal $S_{FB}$ and the detection signal $S_{detect}$. Furthermore, the control unit 230 may generate the control signal $S_c$ to control the duty cycle of the driving voltage $V_d$ according to the detection signal $S_{detect}$.

While the invention has been described by way of example and in terms of preferred embodiment, it is to be understood that the invention is not limited thereto. Those who are skilled in this technology can still make various alterations and modifications without departing from the scope and spirit of this invention. Therefore, the scope of the present invention shall be defined and protected by the following claims and their equivalents.

What is claimed is:

1. An inkjet apparatus, comprising:

a piezoelectric inkjet print head comprising a plurality of nozzles, wherein each the nozzle outputs an ink drop according to a driving voltage;

a plurality of driving units, wherein each of the driving units generates the driving voltage according to a control signal;

a detection unit for detecting a state of the ink drop corresponding to the nozzle to generate a detection signal;

a feedback unit for generating a feedback signal according to the driving voltage; and a control unit for generating the control signal to control the driving voltage according to the detection signal and the feedback signal.

2. The inkjet apparatus as claimed in claim 1, wherein the detection unit comprises an image capture unit for detecting flying speed, drop volume, length of drop tails, flying direction or satellite drop of the ink.

3. The inkjet apparatus as claimed in claim 1, wherein the control unit comprises one of a proportional integral differential controller, a Fuzzy controller and a back propagation controller.

4. The inkjet apparatus as claimed in claim 1, further comprising a memory for storing a parameter corresponding to the control signal.

5. The inkjet apparatus as claimed in claim 1, wherein the feedback unit generates the feedback signal according to an environment parameter.

6. The inkjet apparatus as claimed in claim 5, wherein the environment parameter comprises temperature, humidity, atmospheric pressure or combinations thereof.

7. The inkjet apparatus as claimed in claim 1, wherein the control unit generates the control signal to control a voltage level of the driving voltage according to the feedback signal and the detection signal.

8. The inkjet apparatus as claimed in claim 1, wherein the control unit generates the control signal to control a duty cycle of the driving voltage according to the detection signal.

9. The inkjet apparatus as claimed in claim 1, wherein the driving voltage is a ladder wave, a square wave, a triangle wave, a sine wave or combinations thereof.

10. A calibration method for an inkjet apparatus having a piezoelectric inkjet print head with a plurality of nozzles, comprising:

performing an initial setting for setting a reference voltage;

performing a first process for measuring a driving voltage of the nozzle, and adjusting a voltage level of the driving voltage according to the reference voltage and a control signal, wherein the driving voltage corresponds to the control signal; and performing a second process for detecting an output ink drop of the nozzle, and adjusting the control signal corresponding to the nozzle to control the voltage level or a duty cycle of the driving voltage according to a status of the output ink drop.

11. The calibration method claimed in claim 10, further comprising:

storing a parameter corresponding to the control signal to a memory.

12. The calibration method claimed in claim 11, further comprising:

loading the parameter from the memory to perform a print process of the piezoelectric inkjet print head.

13. The calibration method as claimed in claim 10, wherein performing the initial setting further comprises:

setting a voltage level and a waveform of the reference voltage.

14. The calibration method as claimed in claim 10, wherein performing the first process further comprises:

generating the control signal to drive the nozzle;

measuring the driving voltage of the driven nozzle;

determining whether a voltage difference between the driving voltage and the reference voltage is smaller than or equal to a predetermined voltage; and adjusting the control signal and re-driving the nozzle to measure the driving voltage when the voltage difference is greater than the predetermined voltage.

15. The calibration method as claimed in claim 14, wherein the nozzle is recorded as an abnormal nozzle when the voltage difference is greater than the predetermined voltage and the driving voltage is smaller than the reference voltage during a predetermined period.

16. The calibration method as claimed in claim 10, wherein performing the second process further comprises:

selecting a predetermined nozzle from the nozzles according to a user setting;

generating the control signal to drive the predetermined nozzle;

detecting a flying speed of the output ink drop of the driven predetermined nozzle;

determining whether a speed difference between the flying speed and a target speed is smaller than or equal to a predetermined speed; and adjusting the control signal and re-driving the predetermined nozzle to detect the flying speed when the speed difference is greater than the predetermined speed.

17. The calibration method as claimed in claim 16, wherein the predetermined nozzle is recorded as an abnormal nozzle when the speed difference is greater than the predetermined speed within a predetermined number of adjustment times.

18. The calibration method as claimed in claim 10, wherein performing the second process further comprises:

selecting a predetermined nozzle from the nozzles according to a user setting;

generating the control signal to drive the predetermined nozzle;

detecting a drop volume of the output ink drop of the driven predetermined nozzle;

determining whether a volume difference between the drop volume and a target volume is smaller than or equal to a predetermined volume; and adjusting the control signal and re-driving the predetermined nozzle to detect the drop volume when the volume difference is greater than the predetermined volume.

19. The calibration method as claimed in claim 18, wherein the predetermined nozzle is recorded as an abnormal nozzle when the volume difference is greater than the predetermined volume within a predetermined number of adjustment times.

20. The calibration method as claimed in claim 10, wherein performing the second process further comprises:

adjusting a shoot time of the nozzle.

* * * * *